United States Patent [19]

Hashimoto et al.

[11] Patent Number: 4,966,483

[45] Date of Patent: Oct. 30, 1990

[54] VALVE OPERATING MECHANISM

[75] Inventors: Yasuyuki Hashimoto; Haruo Yamashita, both of Hyogo, Japan

[73] Assignee: Ancos Co., Ltd., Osaka, Japan

[21] Appl. No.: 267,952

[22] Filed: Nov. 7, 1988

[30] Foreign Application Priority Data

| | | | |
|---|---|---|---|
| Nov. 12, 1987 | [JP] | Japan | 62-284367 |
| Feb. 23, 1988 | [JP] | Japan | 63-21810[U] |
| Sep. 20, 1988 | [JP] | Japan | 63-233791 |

[51] Int. Cl.[5] ..... B43K 5/18; B43K 8/04

[52] U.S. Cl. ..... 401/206; 401/263; 222/213

[58] Field of Search ..... 401/270, 273, 278, 279, 401/286, 132, 133, 186, 264, 260, 259, 206, 205, 148, 263; 222/213, 211, 212

[56] References Cited

U.S. PATENT DOCUMENTS

| | | | |
|---|---|---|---|
| 2,121,354 | 5/1938 | Johnson . | |
| 2,417,370 | 3/1947 | Brush . | |
| 2,804,846 | 9/1957 | Rogers | 401/186 |
| 2,849,738 | 9/1958 | Hopkins | 401/272 X |
| 2,866,993 | 1/1959 | Edelstone | 401/270 X |
| 2,908,423 | 10/1959 | Bross | 222/213 |
| 3,087,656 | 4/1963 | Dougherty | 222/213 X |
| 3,154,222 | 10/1964 | Heckman | 222/213 |
| 3,545,874 | 12/1970 | Schwartzman | 401/264 |
| 3,655,290 | 4/1972 | Griffith . | |
| 3,902,815 | 9/1975 | Williams | 401/264 |
| 4,040,753 | 8/1977 | Griffith | 401/186 |
| 4,043,681 | 8/1977 | Funahashi | 401/206 |
| 4,478,358 | 10/1984 | Lantry | 222/213 |
| 4,564,131 | 1/1986 | Lantry | 222/213 |
| 4,588,319 | 5/1986 | Niemeyer | 401/260 |
| 4,773,785 | 9/1988 | Katz | 401/270 |
| 4,867,583 | 9/1989 | Kurokawa | 401/186 |

FOREIGN PATENT DOCUMENTS

| | | | |
|---|---|---|---|
| 543117 | 7/1957 | Canada | 222/213 |
| 1020256 | 11/1957 | Fed. Rep. of Germany | 401/99 |
| 2946870 | 5/1980 | Fed. Rep. of Germany . | |
| 49-34183 | 8/1970 | Japan . | |
| 52-4103 | 1/1977 | Japan . | |
| 52-7226 | 2/1977 | Japan . | |
| 32784 | 8/1980 | Japan . | |
| 58-53684 | 4/1983 | Japan . | |
| 147783 | 10/1983 | Japan . | |

OTHER PUBLICATIONS

European Search Report, Mar. 2, 1989, by Examiner van Oorschot.

*Primary Examiner*—Richard J. Johnson

*Attorney, Agent, or Firm*—Sughrue, Mion, Zinn, Macpeak & Seas

[57] ABSTRACT

A valve operating mechanism comprises a valve having a valve member and a valve seat, the valve seat having a fluid passage hole is arranged at an end of a fluid chamber containing fluid such as liquid or gas, the valve member which is axially moved relative to the valve seat, to thereby control the passage of fluid, an axially movable member spaced a certain distance from the valve seat, radially displaceable members such as thread-shaped members, linear members or bar-shaped members through which the axially movable member is interconnected with a rear part of the body, and means for causing, when a grasping force is applied to the radially displaceable members the valve seat moves relative to the valve member, thus opening the valve, and for causing, when the grasping force is eliminated, the valve seat comes into abutment against the valve member, thus closing the valve.

39 Claims, 12 Drawing Sheets

VALVE OPERATING MECHANISM

BACKGROUND OF THE INVENTION

The present invention relates to a valve operating mechanism in which a valve for controlling the passage of fluid such as liquid or gas is opened by applying a grasping force to radially displaceable members provided at a periphery of a body, and it is closed by removing the grasping force. More particularly, the invention relates to a valve operating mechanism which is widely applicable to a writing instrument such as a so-called "brush-like pen", a marker pen, a correcting liquid bottle and a technical pen, a makeup liquid applying instrument for application of manicure, eyeliner, mascara, etc. a household utensil such as a soy pot, sprayer, and detergent injector detachably connected to a sponge, and appliance using water such as a water supply tube, a sprinkler and a shower, and the like.

A variety of methods of controlling the flow of fluid have been developed for a number of articles, however, they each have problems to be solved as described below.

As to a writing instrument, there has been known a marker pen in which a piece of cotton or the like fitted in an ink tank of the pen in order to control of a supply amount of an ink. In such a type of the pen, an ink is impregnated in the piece of cotton and led to a tip of the pen by means of a capillarity of a pen core or an ink leading core formed of a felt or the like. Such a marker pen is disadvantageous in that an amount of the ink contained in the ink tank decreases due to a volume of the piece of cotton. Further, there has been known another writing instrument in which an ink is contained directly in the ink tank without providing a piece of cotton. Such a writing instrument utilizes a valve operating mechanism for controlling the supply amount of the ink. However, those writing instruments are still disadvantageous in the following points. In the case of the marker pen in which the pen core end is pushed, the pen core must be hard. If the pen core is soft, then its end may be collapsed, or it cannot be pushed. Moreover, such a writing instrument requires a mating member against which the tip end of the pen core is pushed.

In the case of the brush-like pen in which a body is made of flexible material, the ink may leak unexpectedly because it has no valve. Further, the brush-like pen in which the valve is opened by knocking the rear end is relatively intricate in construction and accordingly requires a large number of components. In addition, the brush-like pen would suffer from the difficulty that a large quantity of ink may flow out when the rear end is knocked. Furthermore, such a conventional pen may be inconvenience in that the writer has to change his grasping position whenever the ink is to be supplied to a tip end of the pen.

In one example of the makeup liquid applying instruments, the valve is opening by pushing the end. Accordingly, in the makeup liquid applying instrument, the end should be hard, however, the hard end is not practical in use of the makeup liquid applying instrument. Further, the end may be damaged.

In the case of household utensils, for instance a soy pot suffers from a difficulty that when it falls down, the soy sauce will flow out. Further, a detergent injector is still disadvantageous in that sometimes the sponge must be washed with detergent taken from a detergent container provided separately.

A sprinkler which is connected through a hose to a faucet, and has a valve which is manually operated (opened and closed) is well known in the art. One example of a conventional sprinkler of this type is a hand-held sprinkler in which a part which is moved back and forth while being rotated is provided in front of the sprinkler body. The part thus provided is moved axially while being rotated so as to open and close its valve. In such a hand-held sprinkler, the valve must be opened and closed with both hands. Therefore, it is troublesome to operate the sprinkler, and the water sprinkling operation must be suspended depending on the situation.

A pistol type sprinkler is also known in the art, in which its trigger is pulled with one or two fingers of the hand holding the sprinkler body or released to open or close the valve built in the pistol type sprinkler. This type of the conventional sprinklers are advantageous in that they can be operated with one hand, and the valve can be opened or closed relatively quickly. However, they are still disadvantageous in that they are intricate in construction and accordingly high in manufacturing cost, and they are bulky.

Moreover, the appliances using water also involve a problem that, in order to supply or sprinkle water, a special operation such as an operation of turning on and off a faucet must be carried out.

SUMMARY OF THE INVENTION

Accordingly, an object of this invention is to provide a valve operating mechanism in which the above-described difficulties have been eliminated, and the valve is opened merely by applying a grasping force and it is closed by removing the grasping force without changing the grasping position of fingers.

Another object of the present invention is to provide a valve operating mechanism which can be operated with only one hand holding the body, and the valve can be opened and closed quickly with a relatively small grasping force, and which is simple in design, simple in construction, and low in manufacturing cost.

Further, the other object of the present invention is to provide a valve operating mechanism in which a fluid contained in a fluid tank is supplied continuatively or incontinuatively by operating the valve operating mechanism.

Moreover, the other object of the invention is to provide a valve mechanism in which a fluid contained in a fluid tank is supplied continuatively while controlling a supply amount of the fluid.

The present invention is based upon a technical concept that, even in the case of the valve member which is strongly pushed against the valve seat by a strong spring or water pressure, a relatively small grasping force applied to the radially displaceable members stretched tight can open the valve.

The foregoing and other objects of the invention have been achieved by the provision of a valve operating mechanism which, according to the present invention, comprises: a valve having a valve member and a valve seat; the valve seat having a fluid passage hole is arranged at an end of a fluid chamber (or fluid pipe) containing fluid such as liquid or gas; the valve member which is axially moved relative to the valve seat, to thereby control the passage of fluid (or to block or release the flow of fluid); an axially movable member spaced a certain distance from the valve seat; radially displaceable members such as thread-shaped members, linear members or bar-shaped members (not limited in configuration) through which the axially movable member is interconnected with a rear part of the body; and means for causing, when a grasping force is applied to the radially displaceable members the valve seat moves relative to the valve member, thus opening the valve, and for causing, when the grasping force is eliminated, the valve seat comes into abutment against the valve member, thus closing the valve.

In the valve operating mechanism of the invention, there are substantially two types, that is, when the grasping force is applied to the radially displaceable member, the entire longitudinal length of the body is decreased in one type and maintained unchanged in another.

The valve operating mechanism of the invention is so designed that, while a fluid pressure or an elastic force of a spring is applied, the valve member is pushed against the valve seat, thus closing the valve opening. In this condition, as the grasping force of the fingers holding the body increases, the radially displaceable members are displaced radially inwardly, so that the distance between both ends of the radially displaceable members is decreased. That is, the front end portion and the rear end portion forming the device body or parts of the front and rear end portions are moved towards each other thereby producing a gap between the valve member and the valve seat. As a result, the valve is opened to allow fluid or the like to flow from the rear part opening of the body to the front part opening thereof.

The flow of water or the like can be stopped merely by decreasing the grasping force of the fingers holding the body. That is, as the grasping force decreases, the valve member and the valve seat are moved towards each other by the fluid pressure or the elastic force of the spring while the front end portion and the rear end portion or the parts of the front and rear end portions are moved away from each other. That is, the radially displaceable members are displaced radially outwardly and restored to their original condition. When the radially displaceable members are restored completely to their original condition, the valve member is pushed against the valve seat by the elastic force of the spring or the fluid pressure or the like. Thus, the flow of the fluid is completely stopped.

DESCRIPTION OF THE PREFERRED EMBODIMENTS

Preferred embodiments of this invention will be described with reference to the accompanying drawings.

Figure 1:
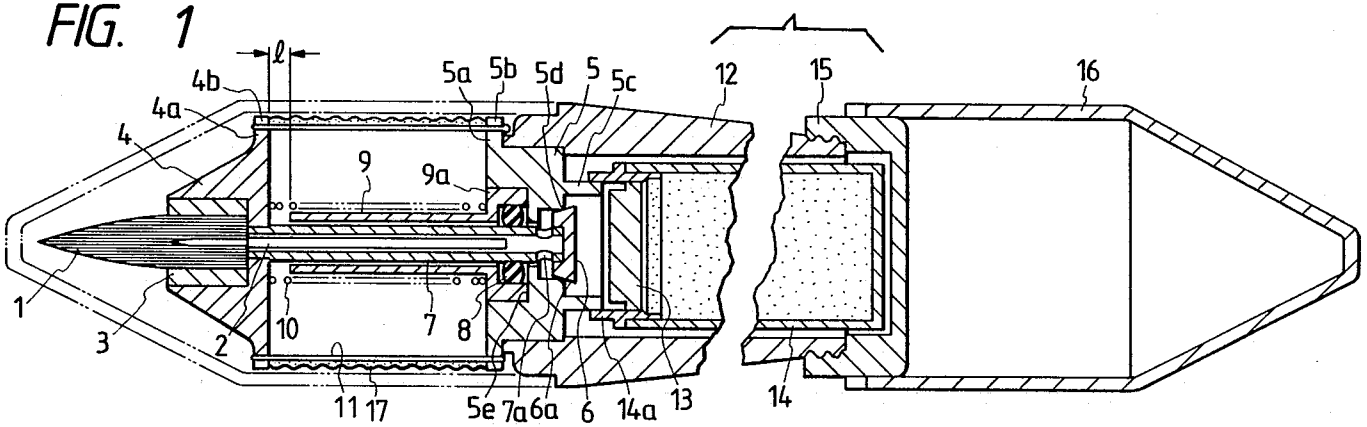
FIG. 1 is a longitudinal sectional view showing a brush-like pen according to a first embodiment of the invention, in which a grasping force is not applied to its radially displaceable members yet.
Figure 2:
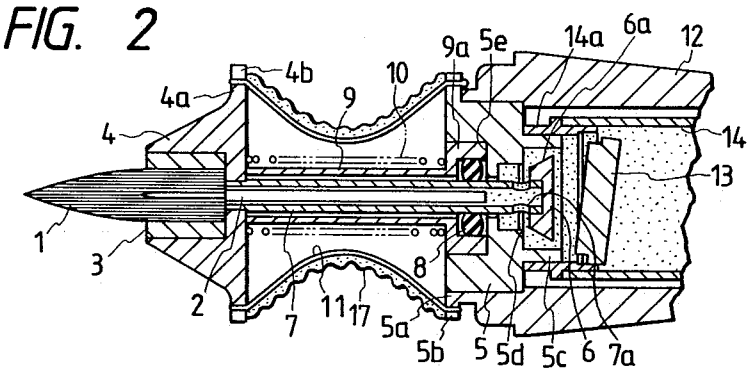
FIG. 2 is a longitudinal sectional view showing the brush-like pen of FIG. 1 in which the grasping force is applied to the radially displaceable members.
Figure 3:
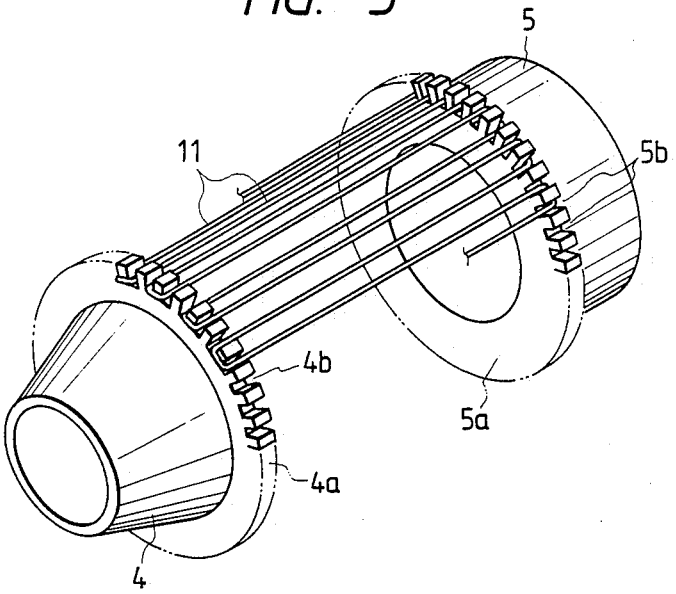
FIG. 3 is an enlarged perspective view showing one example of a radially displaceable member.

FIGS. 1 through 3 show embodiments of the invention which is applied to a so-called "brush-like pen" which is one of the writing instruments. More specifically, FIGS. 1 and 2 are longitudinal sectional views showing essential components of a first embodiment of the invention, and FIG. 3 is a longitudinal sectional view showing essential components of a second embodiment of the invention.

In FIG. 1, a front end portion of an ink leading core 2 is fixedly inserted into a rear end portion of an ear or a soft tip 1. The rear end portion of the ear 1 is held by a holder 3 which is fixedly press-fitted in an axially movable metal member 4. The axially movable metal member 4 has an annular flange **4*a* which forms the periphery of the rear end face thereof. A number of grooves 4*b* are cut in the periphery of the flange 4*a* at equal intervals as shown in FIG. 3**.

The brush-like pen has a valve seat 5 which is provided with an annular flange **5*a* at an outer periphery of the front end thereof. Grooves 5*b* which are equal in number and interval to the grooves 4*b* of the flange 4*a* of the axially movable member 4 are cut in the periphery of the flange 5*a*. The valve seat 5 further comprises a cylindrical cartridge inserting part 5*c* which extends backwardly (to the right in FIG. 1) from the body of the valve seat 5. A valve member 6 for blocking the passage of fluid is provided in such a manner that its relatively long sloped surface 6a abuts against a relatively short sloped surface 5d formed at the edge of the rear end opening of the valve seat 5. A rear end portion of a pipe-shaped leg 7 is fixedly secured to the front part of the valve member 6. At least one ink lead-in opening 7a (four ink lead-in openings in FIG. 1) is formed in a rear end portion of the leg 7 which portion is close to the front end of the valve member 6. An ink leading core 2 is inserted into the leg 7 in such a manner that a small gap is formed therebetween so that when the ink in the cartridge decreases, air is led into the ink chamber through the ear of the writing brush. The valve seat 5 has a front end opening which is closer to the ear 1 than the ink lead-in openings 7a**.

A large diameter rear end portion 9a of a slide pipe 9 in which an O-ring 8 is accommodated is press-fitted in the front end opening of the valve seat 5 so that the O-ring 8 is held between the rear end portion 9a and a step 5e formed inside the seat valve 5. That is, the O-ring 8 elastically abuts against the leg 7 unitary formed with the valve member 6 so that, even when the valve member 6 and the valve seat 5 move axially relative to each other, the O-ring 8 may slightly be moved back and forth, but will never come off. Furthermore, the O-ring 8 is used for preventing the forward leakage of the ink as a water tight.

After a separating spring 10 is interposed between the front end face of the large diameter rear end portion 9a of the slide pipe 9 and the rear end portion of the axially movable member 4, the front end portion of the leg 7 secured to the valve member 6 is fixedly press-fitted into the central hole of the axially movable member 4. In this operation, the sloped surface 6a of the valve member 6 is brought into close contact with the sloped surface 5d of the valve seat 5 so as to block the passage of ink. The separating spring 10 urges the axially movable member 4 to move away from the valve seat 5 and, therefore, the valve member 6 abuts against the valve seat 5 through the leg 7 which is fixedly secured to the axially movable member 4 and the valve member 6. As shown in FIG. 1, a gap l is provided between the front end face of the slide pipe 9 and the rear end face of the axially movable member 4 so that the valve member 6 can move backwardly by the distance l relative to the valve seat 5. The distance l is suitably determined according to the viscosity, kind, consumption and the like of the fluid employed.

As shown in FIG. 3, the axially movable member 4 is coupled to the valve seat 5 by radially displaceable members 11. A rear cylinder 12, in which a cartridge 14 with a lid 13 is replaceably accommodated, is fixedly fit on the valve seat 5 from behind. A cap 15 is detachably and threadably engaged with the rear end portion of the rear cylinder 12. Before the brush-like pen is used, an end cap 16 is mounted on the cap 15 of the rear cylinder 12. In FIG. 1, the brush-like pen further includes a thin rubber cylinder 17 covering the thread-shaped members 11. The rubber cylinder 17 is effective on improving the external appearance of the brush-like pen, and allowing the person to feel soft when grasping the brush-like pen. The material of the cylinder may suitably selected other than rubber, such as a cloth, gauze and the like.

When the brush-like pen is not in use, the end cap 16 is put on the front end portion of the brush-like pen as indicated by one-dot lines in FIG. 1 in such a manner that the rear end portion of the end cap 16 is fitted air-tight on the front end portion of the rear cylinder 12.

In a condition shown in FIG. 1, a front end portion 14a of the cartridge 14 is slightly put on the cartridge inserting part 5c of the valve seat 5, and the lid 13 is not opened yet. When, under this condition, the cartridge 14 is strongly pushed forwardly, the cartridge's front end portion 14a is deeply engaged with the cartridge inserting part 5c so that the cartridge lid 13 is opened as shown in FIG. 2 being pushed by the rear end of the cartridge inserting part 5c.

FIG. 2 shows a condition of the brush-like pen in which, after the cartridge 14 held as shown in FIG. 1 is pushed deeply to allow the forward flow of the ink, the cap 15 is threadably engaged with the rear cylinder 12 (the engagement being not shown), and a grasping force is applied to the radially displaceable members 11.

As the radially displaceable members 11 are bent radially inwardly, the axially movable member 4, the valve seat 5, and the rear cylinder 12 compress the spring 10 until the front end of the slide pipe 9 comes into abutment against the rear end of the axially movable member 4. As a result, the valve member 6 moves backwardly from the valve seat 5, thus forming a gap. That is, the valve member 6 opens thereby allowing the ink to flow through the gap formed between the valve member 6 and the valve seat 5, and flow into the leg 7 through the ink lead-in openings 7a. The ink in the leg 7 is led to the ear 1 by the hollow ink leading core 2. Now, the brush-like pen is ready for writing.

When the grasping force applied to the radially displaceable members 11 is decreased, the brush-like pen restores to the condition of FIG. 1, wherein the valve member 6 is closed to block the flow of the ink.

In the above-described first embodiment, the slide pipe 9 acts also as a stopper for regulating the distance l for which the valve member 6 is allowed to move, however, a stopper may additionally be provided to freely regulate the distance l. Furthermore, a variety of methods may be employed to insert the cartridge and to open the lid. In the above-described embodiment, the gap between the slide pipe 9 and the leg 7 of the valve member 6 is so small that the alignment of the axially movable member 4 and the valve seat 5 are substantially maintained unchanged. However, the alignment can be improved by the following method: A cylinder is extended backwardly from the rear end of the axially movable member 4 so that the cylinder is slidable on the slide pipe 9. In this modification, the separating spring 10 should be suitably provided between the axially movable member 4 and the valve seat 5.

The brush-like pen may be modified as follows: An ink pool is provided behind the ear 1, and the radially displaceable members which are not readily bent radially inwardly are employed. In this case, a writing operation is continued under the condition as shown in FIG. 1, and when the ink becomes not available at the ear, the grasping force is increased to open the valve member 6 thereby supplying the ink into the ink pool. And the grasping force is decreased, to start the writing operation again. Furthermore, the brush-like pen may be modified as follows: The radially displaceable members which, in contrast to those in the above-described modification, can be readily bent are employed, and the degree of opening of the valve member 6 is made smaller, so that the writing operation is continued with the brush-like pen in the state of FIG. 2 while the ink is being supplied at all times during the writing. That is, depending on the kind and use of the writing instrument, the object of the writing operation, the viscosity of the ink, the writing speed, the necessary ink flow rate, etc., the brush-like pen should be so designed that it is used in the condition as shown in FIG. 1 or it is used in the condition as shown in FIG. 2.

Figure 4:
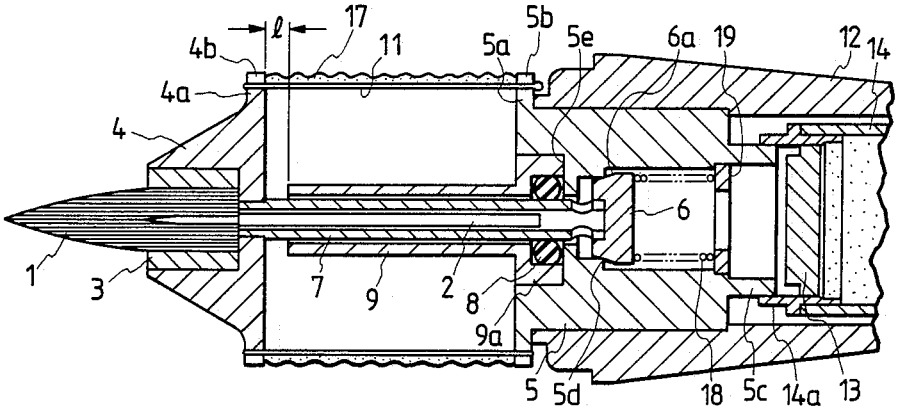
FIG. 4 is a longitudinal sectional diagram showing essential components of a second embodiment of the invention, which is also a brush-like pen.

FIG. 4 is a longitudinal sectional view showing essential component of a second embodiment of the invention which is applied to a brush-like pen.

In the second embodiment, instead of the separating spring, a pushing spring 18 is disposed between the valve member 6 and a spring receiving ring 19 provided in the rear end portion of the valve seat 5. That is, in the second embodiment, the separating spring is not provided inside the radially displaceable members 11 and, therefore, when the grasping force is applied to the radially displaceable members 11, the latter 11 can deeply be bent until it touches the outer cylindrical surface of the slide pipe 9. Therefore, the distance l for which the valve member 6 moves relative to the valve seat 5 can be increased. As is apparent from the above description, in the first embodiment the separating spring 10 is never immersed in the ink, whereas in the second embodiment the pushing spring 18 is maintained immersed in the ink coming out of the cartridge 14. FIG. 4 shows a condition of the brush-like pen in which the cap 13 of the cartridge 14 is not opened yet.

The operation of the second embodiment is similar to that of the first embodiment. The brush-like pen may be so modified that it is used with the radially displaceable members curved radially inwardly or it is used with the radially displaceable members restored.

The above-described brush-like pens are of cartridge type, however, they may be realized as disposable brush-like pens with ink pooled in the rear cylinder. Depending on the kind of ink employed, an agitating ball may be inserted in the ink chamber.

Figure 5:
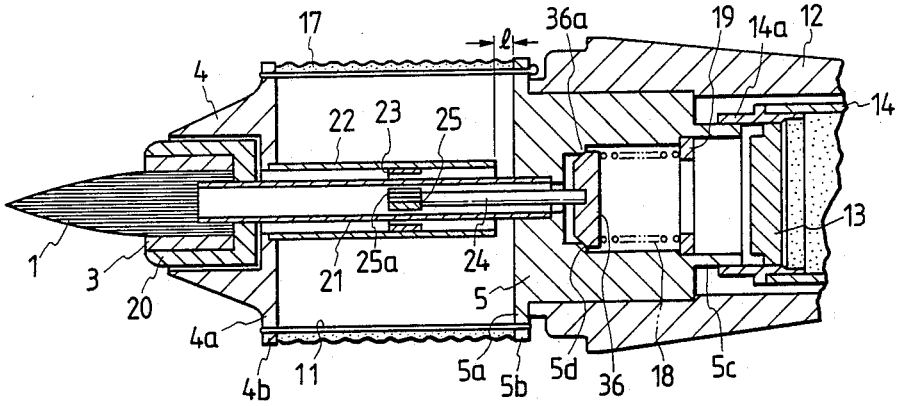
FIG. 5 is a longitudinal sectional view showing essential components of a third embodiment of the invention, which is a makeup liquid applying instrument.

FIG. 5 is a longitudinal sectional view showing essential components of a third embodiment of the invention, which is a makeup liquid applying instrument.

In the third embodiment, the liquid used does not allow the use of an O-ring. That is, in the third embodiment, unlike the first and second embodiments, no O-ring is used. The pushing spring 18 is disposed similarly as in the case of FIG. 4, because it may be held immersed in the liquid.

In FIG. 5, a holder supporting member 20 is connected through a coupling pipe 21 to a valve seat 5. The coupling pipe 21 is made of a material through which a magnetic flux can pass. A front end position of a slide pipe 22 is press-fitted into the central hole of an axially movable member 4. The slide pipe 22 is made of magnetic shielding material. An annular magnet 23 is provided in the slide pipe 22. A short-bar-shaped magnet 25 having several grooves **25*a* cut in its cylindrical wall is connected to the end of a leg 24 of the valve member 36 (or the left end of the leg 24** in FIG. 5).

The magnet 25 at the end of the leg 24 of the valve member 36, and the magnet 23 provided in the magnetic shielding slide pipe 22 are so positioned that, with the valve member 36 abutting against the sloped surface **5*d* of the valve seat 5 by the elastic force of the pushing spring 18, the magnet 25 confronts with the magnet 23 through the coupling pipe 21. These magnets 23 and 25** attract each other strongly.

As a grasping force is applied to radially displaceable members 11 to bend the latter radially inwardly, the axially movable member 4 and the valve seat 5 move a distance l towards each other. In this operation, the magnet 23 also moves towards the valve seat 5 and, therefore, inside the coupling pipe 21 the magnet 25 mounted at the end of the leg 24 of the valve member 36 moves towards the valve seat 5 in association with the movement of the magnet 23. Accordingly, the valve member 36 moves away from the valve seat 5 through the leg 24 while compressing the spring 18, that is, the valve is opened. When the grasping force is decreased, the valve is closed by the elastic force of the spring 18, and the magnets 23 and 25 move forwardly. The resultant condition of the makeup liquid applying instrument is as shown in FIG. 5.

In the third embodiment of FIG. 5, unlike the first and second embodiments, the entire length is maintained unchanged at all times during the operation. That is, since the holder supporting member 20 is connected through the coupling pipe 21 to the valve seat 5, the length from a tip end of the ear 1 to the valve seat 5 is maintained unchanged. In the third embodiment, it is essential that the force of attraction of the magnets 23 and 25 is larger than the elastic force of the pushing spring 18.

The magnets may be so positioned that one of the magnets is at the rear end of the slide pipe 22 and the other is at the front end of the valve member 36 in such a manner that they are urged away from each other. In this modification, the magnets face each other through the front end portion of the valve seat, and therefore the front end portion must be of a material through which a magnetic flux can pass.

The above-described makeup liquid applying instrument may be so designed that it is used with the grasping force applied to the radially displaceable members; that is, with the valve opened, or it is used with the grasping force applied to the radially displaceable members decreased (restored), that is, with the valve closed.

In the above-described third embodiment, the leg 24 of the valve member 36 is designed like a rod, and it has no fluid lead-in opening. Furthermore, the front end portion of the coupling pipe 21 is inserted into the ear 1, and accordingly no fluid leading core is provided.

Figure 6:
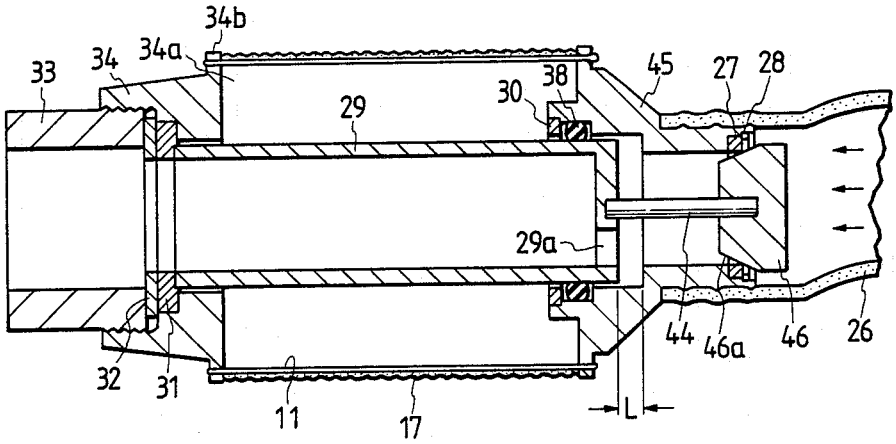
FIG. 6 is a longitudinal sectional view showing essential components of a fourth embodiment of the invention, which is an appliance using water.

FIG. 6 is a longitudinal sectional view showing a fourth embodiment of the invention which is applied to an appliance using water.

In FIG. 6, a front end portion of a water supply tube 26 formed of rubber is fixedly connected to a rear end portion of a valve seat 45. A water pressure is applied in the direction of the three arrows shown in FIG. 6 by the water in the rubber tube 26 so that a valve member 46 is strongly pushed against a packing 27 at the rear end opening of the valve seat 45. Behind the packing 27, a packing retaining ring 28 is fixedly press-fitted in the valve seat 45, to retain the packing 27. A leg 44 is extended forwardly from the valve member 6, the leg 44 and the valve member 46 forming one unit. A cylinder 29 having at least one hole **29*a* (three holes 29*a* in FIG. 6) in its bottom (or rear end face) is connected to the end of the leg 44. An O-ring 38 is provided between the outer wall of the rear end portion of the cylinder 29 and the inner wall of the valve seat 45. An O-ring retaining ring 30 is press-fitted into the valve seat 45, to prevent the O-ring 38** from coming off.

An axially movable member 34 is coupled to the valve seat 45 through radially displaceable members 11. A packing 31 is engaged with a step formed in the axially movable member 34 in such a manner that it is in close contact with the front end opening of the cylinder 29. A water injecting pipe 33 is threadably engaged with the axially movable member 34 through a washer 32. The front end of the water injecting pipe 33 is connected, for instance, to a sprinkler.

The operation of the fourth embodiment of the invention shown in FIG. 6 will be described.

In a condition of FIG. 6, the flow of the water in the tube 26 is blocked by the valve member 46 which abuts against the packing 27 on the valve seat 45 by the water pressure. When, under this condition, a grasping force is applied to the radially displacement members 11, the latter are bent radially inwardly until they touch the cylinder 29. In this operation, the axially movable member 34 moves backwardly, towards the valve seat 45. That is, the water injecting pipe 33, the washer 32, and the packing 31 push, as one unit, the cylinder 29, which in turn pushes the valve member 46 through the leg 44 until a gap L between the cylinder 29 and the valve seat 45 is eliminated; that is, the valve is opened. As a result, the water gushes out of the water supply tube 26, flows into the cylinder 29 through the holes 29*a*, and flows out of the water injecting pipe 33. In this operation, the leakage of the water from the cylinder 29 is prevented by means of the O-ring 38. The provision of the, O-ring 8 and the O-ring retaining ring 30 may be eliminated if the rubber cylinder 17 is made of durable material and is disposed between the axially movable member 34 and the valve seat 45 so as to obtain a water-tight. In this case, a slit, hole or the like may be formed in the cylindrical wall of the cylinder 29.

When the grasping force applied to the radially displaceable members 11 is decreased, the valve member 46 is closed by the water pressure, thus blocking the flow of water as shown in FIG. 6.

Figure 7:
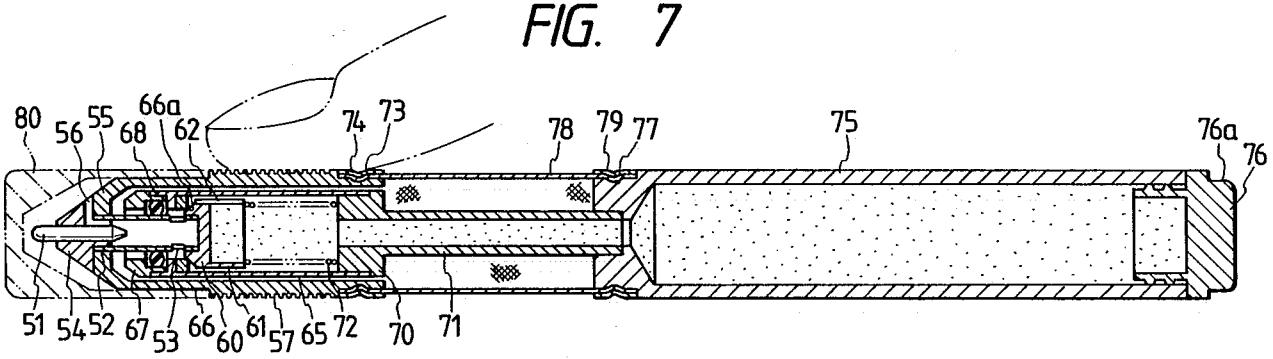
FIGS. 7 and 8 are longitudinal sectional views of a valve operating mechanism according to a fifth embodiment of the present invention which is applied to a writing instrument.
Figure 8:
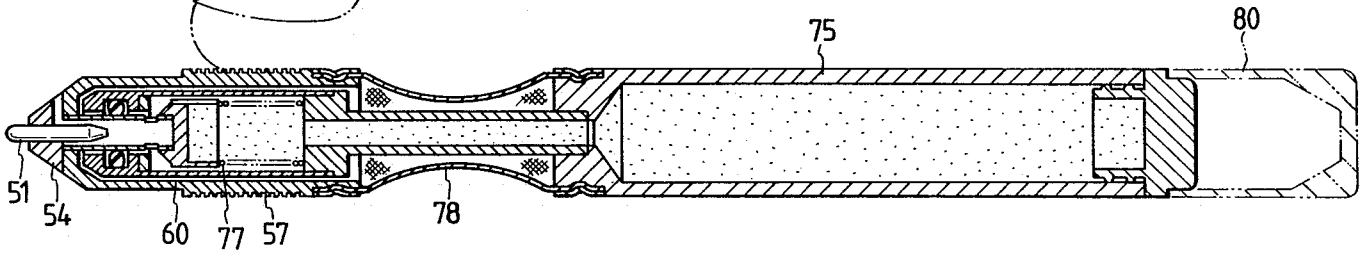

FIGS. 7 and 8 are longitudinal sectional views of a valve operating mechanism according to a fifth embodiment of the present invention which is applied to a writing instrument.

The writing instrument is provided with a pen core 51 formed of a felt or the like. The writing operation is obtained by a tip end of the pen core 51. The pen core 51 is fixed in a tapered member 54 of a cylindrical front cap 55 so that the pen core 51 protrudes from an opening of an opening of the tapered member 54 of the front cap 55. An ink lead-in pipe 52 is inserted into a rear end of the tapered member 54 and fixed thereto. Rectangular-shaped ink lead-in openings 53 are disposed at a middle portion of the ink lead-in pipe 52 in the opposite direction to each other. The front cap 55 is fixed to the outer surface of the front end of the ink lead-in pipe 52. The tapered member 54 of the front cap 55 is provided with an air hole 56 communicating with an inner side of the ink lead-in pipe 52. A pipe-like grasp cylinder 57 is provided at a rear portion of the front cap 55 and unitary formed thereon. An outer periphery of the grasp cylinder 57 has a notched surface so as not to slip when the grasp cylinder 57 is actually grasped by a writer's fingers.

A rear end of the ink lead-in pipe 52 is fixedly inserted in a valve member 60 having a tapered front end and a cylindrical rear end 61. A plurality of ink through hole 62 are formed on the cylindrical rear end 61 of the valve member 60 at regular interval. The valve member 60 is disposed in a cylindrical ink container 65 and axially slidable therein. A doughnut-like valve seat 66 is firmly fitted inside of the ink container 65. The valve seat 66 has a round corner 66*a* which is closely contactable to the valve member 60 thereby forming so-called a "valve".

A cap 67 is fitted in a front end opening of the ink container 65 which positions at an outer periphery of the ink lead-in pipe 52. An O-ring 68 is inserted between an inner periphery of the cap 67 and the outer periphery of the ink lead-in pipe 52. An rear end of the ink container 65 is fixed to a front end of an ink communicating pipe 70. A spring 72 is disposed between the front end of the ink communicating pipe 70 and the valve member 60, which spring urges the valve member 60 toward the valve seat 66. A rear end of the ink communicating pipe 70 extends axially to form a coupling pipe 71 a rear end of which is fixedly inserted in a front end of a cylindrical ink tank 75. The ink tank 75 is made hollow to thereby contain a liquid ink. The ink tank 75, coupling pipe 71, grasp cylinder 75 and front cap 55 forms a writing instrument body.

A tail cap 76 is fitted in a rear end opening of the ink tank 75 thereby preventing any leakage of the ink. The ink tank 75 is provided with an outer groove 77 at a front end thereof. A rear end of a radially displaceable members 78 is wound on the outer groove 77 and urgedly fixed thereto by a cloth retaining ring 79. The radially displaceable members 78 is formed of flexible synthetic fiber. On the other hand, a front end of the radially displaceable members 78 is wound on an outer groove 73 disposed at an outer periphery of a rear end of the grasp cylinder 57 and urgedly fixed thereto by a retaining ring 74.

A body cap 80 may be provided so as to prevent the pen core 51 from drying. The tail cap may have a fitting portion 76*a* for fitting the body cap 80 during the actual writing.

An operation of the writing instrument of the first embodiment of the present invention will now be described.

During the actual writing, an outer periphery of the grasp cylinder 57 is held by a writer's fingers, more specifically by a thumb and a forefinger. The cap 80 is removed from the front cap 55 thereby actually writing with a tip end of the pen core 51. When the ink contained in the pen core 51 is consumed during the writing, the forefinger of the writer is leveled down, while grasping the grasp cylinder 57, thereby pushing the radially displaceable members 78 by a bulb of the forefinger as shown in FIG. 8. As a result, the radially displaceable members 78 bends radially and, accordingly, the grasp cylinder 57 is moved towards the ink tank 75 side (rearwardly) so that the front cap 55, tapered member 54, pen core 51 and ink lead-in pipe 52 move rearwardly since the grasp cylinder 57 and the front cap 55 are unitary formed. Further, the valve member 60 moves rearwardly since the valve member 60 and the ink lead-in pipe 52 are fixedly fitted. The valve member 60 moves rearwardly while compressing the spring 72 so that a gap is produced between the valve member 60 and the valve seat 66 thereby introducing the ink contained in the ink container 65 into the ink lead-in opening 53 through the slit 62. The ink introduced from the ink lead-in opening 53 is supplied to a tip end of the pen core 51 through the ink lead-in pipe 52.

When the radially displaceable members 78 is released from being pushed by the bulb of the writer's forefinger, the valve member 60 comes into abutment against the valve seat 66 by an elastic force of the spring 72 thereby closing the valve. In this condition, the ink lead-in pipe 52 contains therein the ink and, therefore, the writing operation can be continued while the grasp cylinder 57 is grasped by the writer's fingers. In the fifth embodiment described above, the ink is interval supplied when required.

Figure 9:
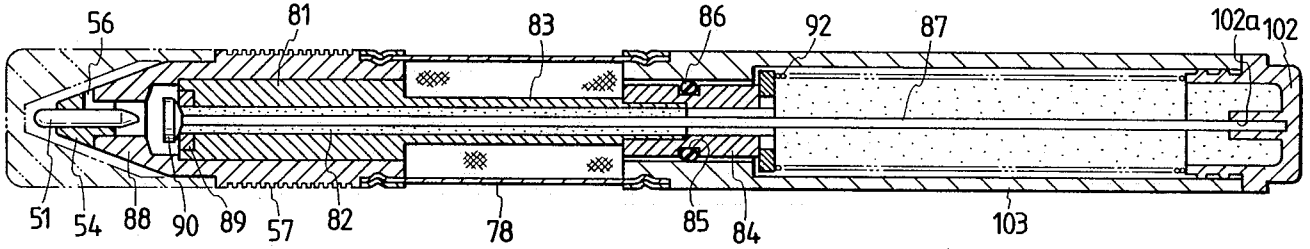
FIG. 9 is a longitudinal sectional view showing a sixth embodiment of the invention which is applied to a writing instrument.

FIG. 9 is a longitudinal sectional view showing a sixth embodiment of the invention which is applied to a writing instrument. According to the sixth embodiment, an entire longitudinal length of the writing instrument body is shortened when the valve operating mechanism is operated as is the same as the fifth embodiment described above.

A pen core 51 is formed of a felt or the like and the actual writing operation is obtained by a tip end of the pen core 51. The pen core 51 is inserted into a tapered member 54 and fixed thereto so that the pen core 51 protrudes from an end of the tapered member 54. The tapered member 54 is provided with an air through hole 56 and press fitted into a hollow front metal 88 from a front end opening thereof. A cylindrical valve seat holder 81 is inserted into and fixed to the front metal 88 at a middle and rear part thereof. The valve seat holder 81 has a through hole 82 at an axially central portion thereof. A valve seat 89 is fitted to a front end of the through hole 82. A rear part of the valve seat holder 81 is reduced in diameter to form a coupling pipe 83 a rear most end of which is inserted into and coupled to a cylinder member 84. An outer periphery of the cylinder member 84 is provided with an O-ring groove 85 fitting therein an O-ring 86. The O-ring 86, after assembled, slidably contacts to an inner peripheral surface of an ink tank 103. The ink tank 103 is made cylindrical thereby containing therein an ink. A tail cap 102 is press fitted into a rear end opening of the ink tank 103.

A valve member 90 is disposed at a front side of the valve seat 89. A connecting bar 87 is unitary formed on a rear end of the valve member 90, which bar is fitted into a hole **90*a* of the tail cap 102. A fixed structure of a radially displaceable members 78** is the same as that of the fifth embodiment and, therefore, is not explained in detail.

A fundamental operation of the writing instrument of the sixth embodiment is the same as that of the fifth embodiment. When the radially displaceable members 78 is pushed by a bulb of a writer's forefinger during the writing, the grasp cylinder 57 is urged to move rearwardly together with the front cap 88 and valve seat holder 81. As a result, the entire longitudinal length of the writing instrument body is shortened. In this condition, however, the valve member 90 does not move since the connecting bar 87 is fixed to the tail cap 102. Therefore, a gap is produced between the valve member 90 and the valve seat 89, that is, a valve is opened. Then, the ink contained in the ink tank 103 is supplied to the pen core 51. When the radially displaceable members 78 is released from being pushed by the bulb of the writer's forefinger, the valve member 90 comes into abutment against the valve seat 89 and, accordingly, the valve is closed.

Figure 10:
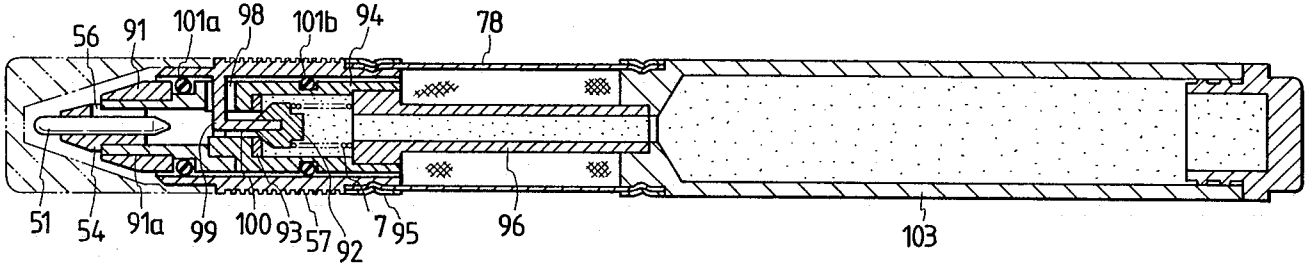
FIG. 10 is a longitudinal sectional view showing a writing instrument according to a seventh embodiment of the present invention.

FIG. 10 is a longitudinal sectional view showing a writing instrument according to a seventh embodiment of the present invention. According to the fifth and sixth embodiments described above, the entire longitudinal length of the writing instrument body is shortened while the valve operating mechanism is operated. However, in the seventh embodiment, the entire longitudinal length of the writing instrument body does not change even if the valve operating mechanism is operated.

In the seventh embodiment, a pen core 51 and a tapered member 54 has the same structure as that of the fifth and sixth embodiments. A grasp cylinder 57 is positioned at an outer rear periphery of a front cap 91 and slidably moves forwardly and rearwardly. The grasp cylinder 57 provided with a plurality of connecting legs 99. More specifically, three connecting legs 99 extend toward radially inside of the writing instrument body and pass through slits 98 formed on the front cap 91. The connecting legs 99 is provided with a connecting bar 100 extending rearwardly at a center of the writing instrument body and fitting to a front end of the valve member 92. The grasp cylinder 57 contains therein the ink container 94 a front end of which is unitary coupled to a rear end of a cylinder **91*a* which is unitary formed with the front cap 91**.

O-rings **101*a* and 101*b* are fitted on an outer periphery of the cylinder 91*a* and the ink container 94, respectively, thereby containing a fluid tight and are slidable with respect to the grasp cylinder 57. The ink container 94 mounts therein a valve member 92 and a front end of the ink communicating pipe 95 is fitted into a rear end opening of the ink container 94. A rear end of a coupling pipe 96 unitary formed with the ink communicating pipe 95 is fitted into a front end opening of an ink tank 103. A coil spring 97 is disposed between a rear end of the valve member 92 and a front end of the ink communicating pipe 95. A fixed structure of a radially displaceable members 78** is the same as that of the fifth embodiment and, therefore, is not explained in detail.

The operation of the writing instrument according to the seventh embodiment of the invention will be described below.

During the actual writing, the outer periphery of the grasp cylinder 57 is grasped by a thumb and forefinger of the writer as is the same as that of the above embodiments. If the ink penetrating in the pen core 51 is consumed and decreased, the radially displaceable members 78 is pushed by the bulb of the writer's forefinger so that the radially displaceable members 78 is radially displaced and axially shortened. In this condition, the grasp cylinder 57 is urged to move rearwardly while sliding on the O-rings **101*a* and 101*b*, together with the connecting legs 99, connecting bar 100 and the valve member 92. The coil spring 97 is compressed by the valve member 92 thereby producing a gap between the valve member 92 and a valve seat 93**.

As a result, the ink contained in the ink tank 103 is supplied to the pen core 51 through the coupling pipe 96, the gap between the valve 92 and the valve seat 93. If the radially displaceable members 78 is released, the coil spring 97 urges the valve 92 to come into abutment against the valve seat 93. Thus, the valve is closed.

Figure 11:
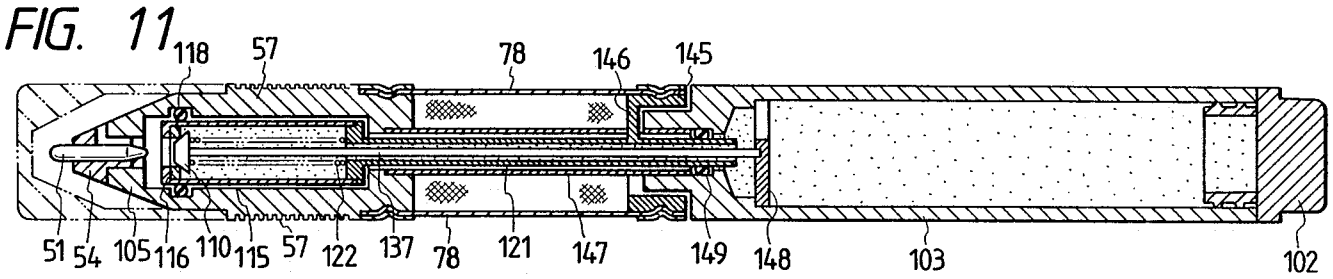
FIG. 11 is a longitudinal sectional view showing a eighth embodiment of the present invention.

FIG. 11 is a longitudinal sectional view showing a eighth embodiment of the present invention. According to the eighth embodiment, the entire longitudinal length of the writing instrument body does not change when the valve operating mechanism is operated as is like that of the seventh embodiment.

A pen core 51, tapered member 54 and front cap 105 are substantially the same as that of the seventh embodiment as is apparent from FIG. 11. The front cap 105 and the grasp cylinder 57 are unitary formed. The grasp cylinder 57 has therein a space in which a cylindrical ink container 115 is mounted. An O-ring 118 is fitted in a groove formed on an inner peripheral surface of the front cap 105.

The ink container 115 slidably contacts to the O-ring 118. The ink container 115 mounts therein a valve member 110 an end of which is unitary connected to a connecting bar 137 an end of which is fixed to a connecting plate 148 fixedly mounted in the ink tank 103. A coupling pipe 121 is coupled to a rear end of the ink container 115 a central through hole of which communicates with the ink container 115.

A rear end of the coupling pipe 121 is slidably inserted into the front part of the ink tank 103. An O-ring 149 is disposed in the tank 103 in order to prevent any leakage of the ink from a sliding surface of the coupling pipe 121 and the ink tank 103. The coupling pipe 121 is provided with three connecting legs 146 at regular interval at an outer periphery thereof, which legs extend radially outside of the writing instrument body. The coupling pipe 121 and the connecting legs 146 are unitary formed. An outer end of each connecting legs 146 extends axially rearwardly to form a cylindrical sliding member 145 which slides when the writing instrument is actually operated.

A radially displaceable members 78 is fixed between a rear end of the grasp cylinder 57 and the sliding member 145. A fixing pipe 147 is fixed between the rear end of the grasp cylinder 57 and the front end of the ink tank 103 so that the grasp cylinder 57 and the ink tank 103 do not move relative to each other.

An operation of the writing instrument according to the eighth embodiment of the invention will be described below.

During the writing, the grasp cylinder 57 is grasped by a writer's fingers as is the same as that of the embodiments described above. When the ink penetrating in the pen core 51 is consumed and decreased, the radially displaceable members 78 is pushed by a bulb of the writer's forefinger. Then the radially displaceable members 78 is radially displaced thereby urging the sliding member 145 to move axially frontwardly toward the grasp cylinder 57 side, together with the coupling pipe 121 and the ink container 115 since the coupling pipe 121 and the sliding member 145 are unitary formed. Accordingly, the ink container 115 moves forwardly while compressing the coil spring 122 and sliding on the O-ring 118 thereby producing a gap between the valve member 110 and the valve seat 116.

The ink contained in the ink tank 103 passes through the coupling pipe 121, ink container 115 and gap between the valve member 110 and the valve seat 116, and penetrates in the pen core 51. When the radially displaceable members 78 is released from being pushed and restores to its original condition, the valve member 110 comes into abutment against the valve seat 116, that is, the valve is closed.

Figure 12:
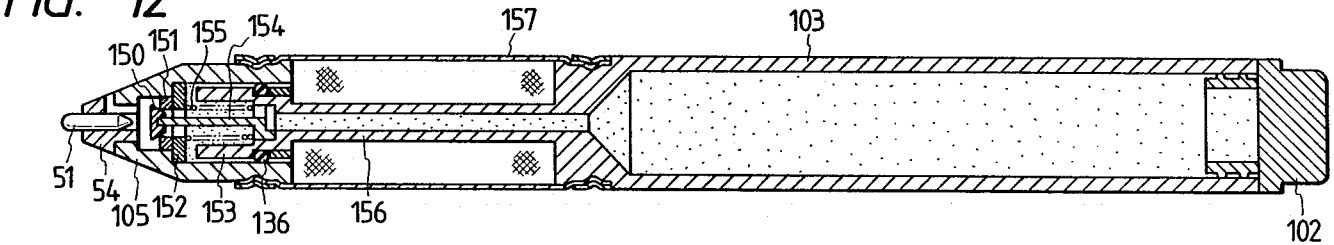
FIGS. 12 and 13 are longitudinal sectional views showing a writing instrument according to the ninth embodiment of the invention.
Figure 13:
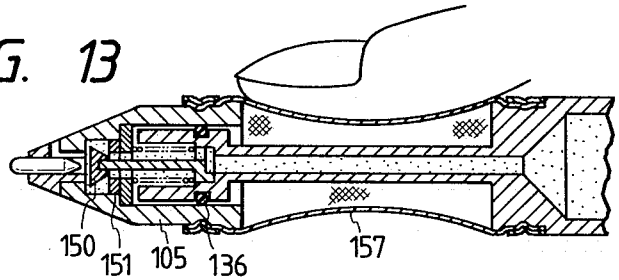

FIGS. 12 and 13 are longitudinal sectional views showing a writing instrument according to the ninth embodiment of the invention. In the ninth embodiment, a valve opening mechanism can be operated during the actual writing, such is different from the fifth to eighth embodiments described above. Further, in the ninth embodiment, an entire longitudinal length is shortened when the valve operating mechanism is operated.

The writing instrument of the ninth embodiment is not provided with a grasp cylinder. A writer directly grasps the radially displaceable members during the writing. That is, the radially displaceable members acts also as a grasp cylinder. A pen core 51 and a tapered member 54 are the same structure as that of the foregoing embodiments as shown in FIG. 11. A valve seat 151 is fixed on an inner periphery of a front cap 105 at a rear side of the pen core 51. The valve seat 151 is supported by a valve seat supporting member 152 fixed to a step portion of the front cap 105. An ink tank 103 is provided at a front end thereof with a coupling pipe 156 which is cylindrical and has a small diameter. The coupling pipe 156 has a spring case 153 at a front end thereof, which case is unitary formed with the coupling pipe 156. A valve member 150 connects to the coupling pipe 156 through a connecting bar 154. A coil spring 155 is disposed between the spring case 153 and the valve seat supporting member 152. An O-ring 156 is fitted on an outer periphery of the spring case 153. An outer periphery of the O-ring 156 and an inner periphery of the front cap 105 are axially slidable with each other. A front and rear ends of the radially displaceable members 157 is fixed to a rear end of the front cap 105 and a front end of the ink tank 103, respectively, in such a manner as described in the foregoing embodiments.

An operation of the writing instrument of the ninth embodiment will be described.

During the actual writing, the radially displaceable members 157 is grasped by a writer's fingers as shown in FIG. 13. In this condition, the radially displaceable members 157 is radially displaced thereby urging the front cap 105 to move rearwardly, together with the valve seat 151 and the valve seat supporting member 152, so that the coil spring 155 is compressed by the valve seat supporting member 152. Since the valve member 150 does not move in such an operation, a gap is produced between the valve member 150 and the valve seat 151 thereby supplying an ink contained in the ink tank 103 to the pen core 51 through the coupling pipe 156. That is, the ink is always supplied to the pen core 51 during the writing. If the writer grasps the radially displaceable members 157 with a large grasp force, the gap between the valve member 150 and the valve seat 151 becomes large and, accordingly, a supplying amount of the ink increases.

Another arrangement is applicable in which the valve is closed when the writer's grasp force grasping the radially displaceable members 157 is under a predetermined level during the writing.

Figure 14:
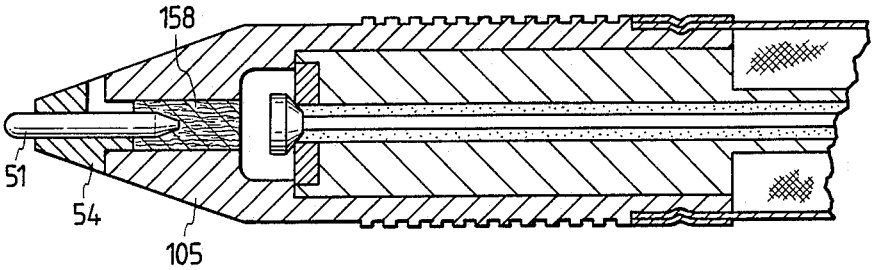
FIG. 14 is a partial longitudinal sectional view showing an arrangement of a pen core.

FIG. 14 is a partial longitudinal sectional view showing another arrangement of a pen core. According to this arrangement, the pen core 51 is held by a tapered member 54 press-fitted into a front cap 105. A cotton-like member 158 is inserted in the front cap 105 at a rear side of the tapered member 54. The cotton-like member 158 can contain the ink and controls an amount of the ink supplied to the pen core 51 thereby absorbing the variation of the supply amount of the ink due to the variation of the writer's grasping force.

Figure 15:
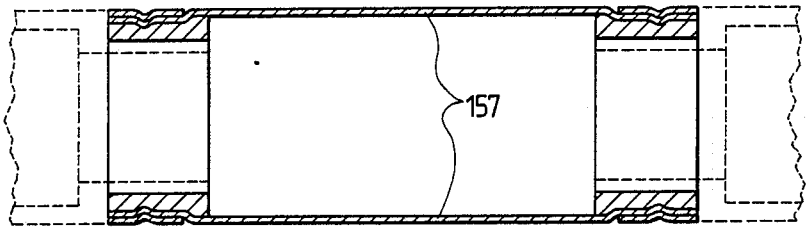
FIG. 15 shows an arrangement of the radially displaceable members.

FIG. 15 shows an arrangement of the radially displaceable members in which each of a front and end portions of the radially displaceable members 157 is fixed by an inner and outer retaining rings, thereby forming a unit of the radially displaceable member.

Figure 16:
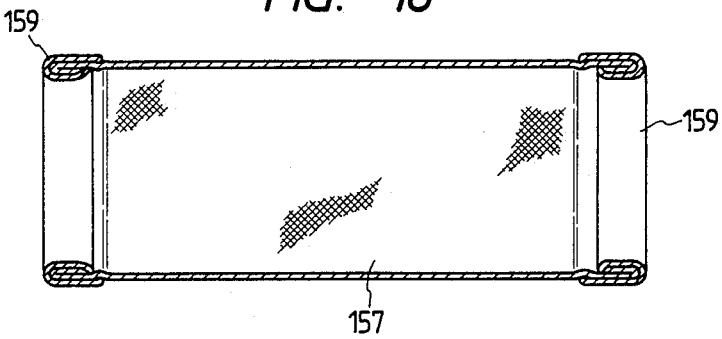
FIG. 16 shows another arrangement of the radially displaceable members.

FIG. 16 shows another arrangement of the radially displaceable members in which each of a front and end portions of the radially displaceable members 157 is fixed by a U-shaped metal retainer 159 thereby forming a unit of the radially displaceable member.

Figure 17:
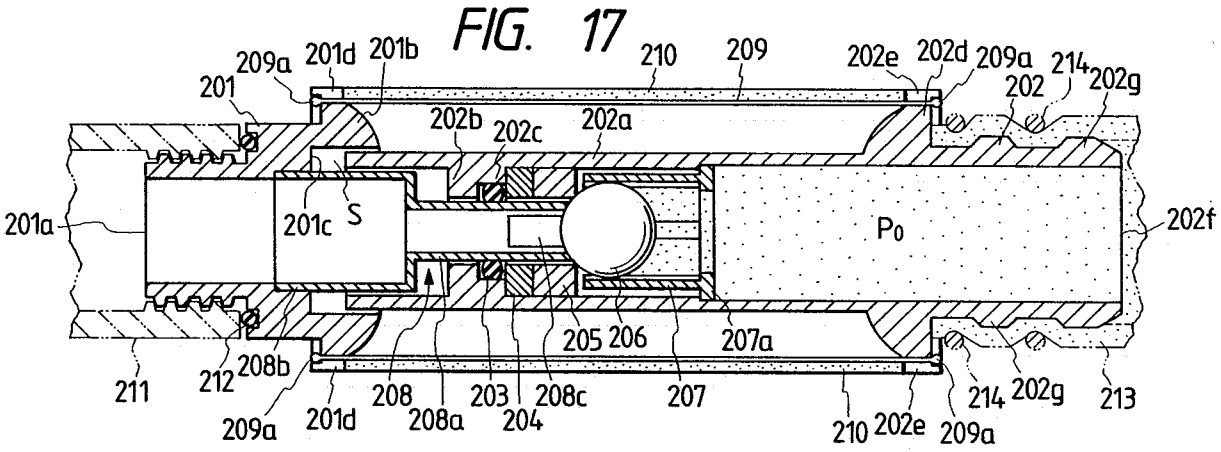
FIGS. 17 and 18 are longitudinal section views showing a tenth embodiment of this invention.
Figure 18:
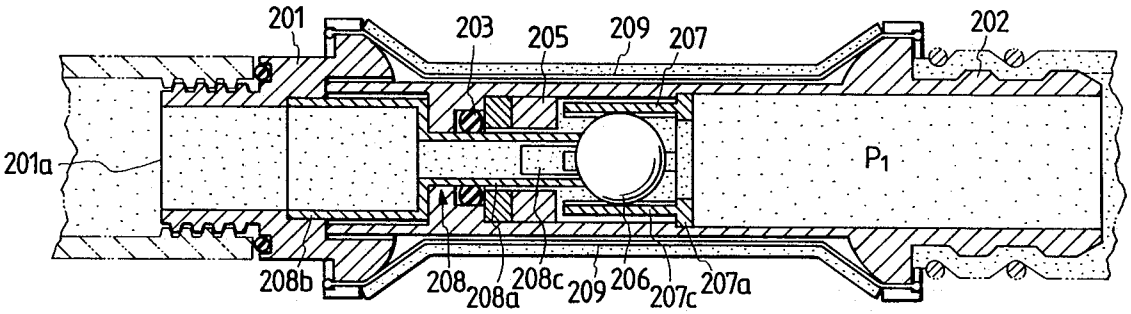

FIGS. 17 and 18 are longitudinal sectional views showing a tenth embodiment of this invention.

In FIG. 17, a front cylinder 201 forming a front end portion of the body opens at a front end, thus forming a lead-in opening **201*a*. A rear cylinder 202 opens at the rear end, thus providing a lead-in opening 202*f*. The rear cylinder 202 extends forwardly (to the left in FIG. 17), thus forming an extension 202*a*. A front end portion of the extension 202*a* is inserted into a large diameter hole in a rear end portion 201***b* of the front cylinder 201 in such a manner that the rear cylinder 202 is axially slidable. A gap S is provided between a step 201C formed on an inner cylindrical wall of the rear end portion 201*b* of the front cylinder 201 and the front end face of the extension 202*a* so that front cylinder 201 can retract by a distance of the gap S. In this connection, the front end face of the extension 202*a* acts as a stopper to prevent the front cylinder 201 from retracting more than the distance of the gap S.

A step 202*b* minimum in inside diameter is formed on the inner cylindrical wall of the front portion of the extension 202*a* of the rear cylinder 202, and another step 202*c* is formed behind the step 202*b* in such a manner that the step 202*c* is integral with the step 202*b*. An O-ring 203 is press-fitted in the step 202*c* in such a manner that it abuts against the inner wall of the step 202*c*, so that it is retained there. A ring-shaped packing member forming a valve seat 205 is inserted from behind until it abuts through an O-ring retainer 204 against the wall of the step 202*c*. In order to prevent the backward displacement of the valve seat 205, a valve seat retaining ring (not shown) may be press-fitted to retain the valve seat 205. The inner circumferential edge of the rear end face of the valve seat 205 is slightly chamferred.

Figure 19:
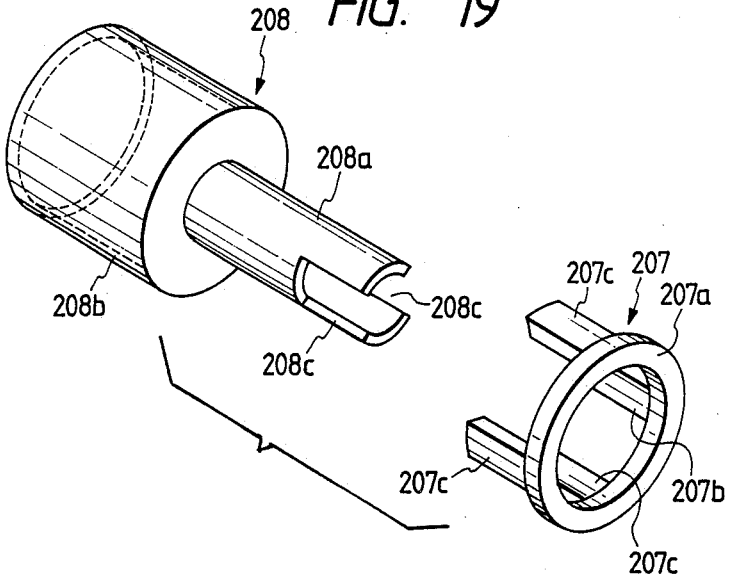
FIGS. 19 and 20 are perspective views showing essential components in the tenth embodiment.

Behind the valve seat 205, a spherical valve member 206 is inserted in the rear cylinder in such a manner that it is axially slidable. In order to prevent the vibration of the valve member 206 due to the flow of the fluid, a cage 207 as shown in FIG. 19 is fixedly press-fitted in the rear cylinder 202. The cage 207 has a ring 207*a* at a rear end thereof an inside diameter of which is slightly smaller than a diameter of the valve member 206, and a plurality of surrounding members 207*c* extending forwardly from the ring 207*a*. Each surrounding members 207*c* has an inner surface 207*b* (shown in FIG. 19) which forms a phantom cylinder whose diameter is slightly larger than the diameter of the valve member 206.

A valve pushing member 208 is disposed in front of the valve member 206. The valve pushing member 208 is provided with a rear cylindrical part 208*a* which is slidably inserted into the O-ring 203, and a front cylindrical part 208*b* extending forwardly from the rear cylindrical part 208*a*. The front cylindrical part 208*b* has an inside diameter larger than that of the rear cylindrical part 208*a*. The valve pushing member 208 opens at both ends. The rear end portion of the rear cylindrical part 208*a* is divided into two parts thereby forming slots 208*c* and 208*c* as shown in FIG. 19. The front cylindrical part 208*b* moves back and forth being guided by the inner cylindrical wall of the front end portion of the elongation 202*a* of the rear cylinder 202. The front cylinder 201 is mounted on the front end portion of the front cylindrical part 208*b*.

Figure 20:
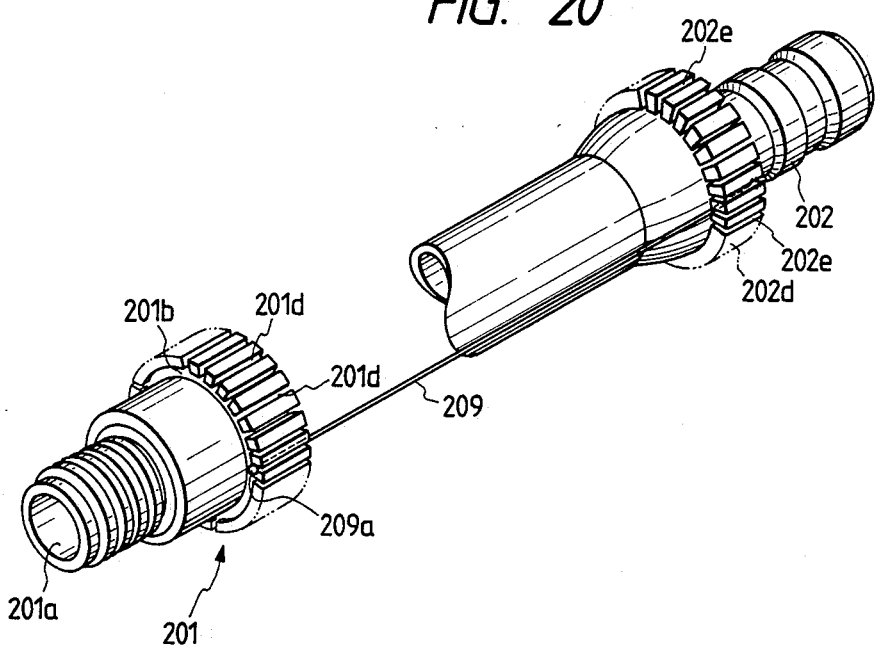

The front cylinder 201 and the rear cylinder 202 are coupled to each other with a radially displaceable members 209 such as a thread-shaped member formed of resin mono-filaments, cloth or the like. As shown in FIG. 20, a plurality of grooves 201*d* are cut in the rear end portion 201*b* of the front cylinder 201 at equal angular intervals, and grooves 202*e*, the number of which is equal to that of the grooves 201*d* are formed in the flange 202*d* of the rear cylinder 202 at equal angular intervals, The radially displaceable members 209 are inserted into the grooves 201*d* and the grooves 202*e*, respectively, and each of the radially displaceable members 209 thus inserted has pillings 209*a* at both ends. In FIG. 17, the valve operating mechanism further includes a grip cylinder 210 which covers the radially displaceable members 209.

The outer wall of the front end portion of the front cylinder 201 is threaded, so that an adaptor (such as a water spraying device) 211 can threadably be connected thereto. An O-ring 212 may be interposed between the adaptor 211 and the front cylinder 201. The front cylinder 201 may be so designed that the adapter 211 can be connected thereto in one action. Several annular keys 202*g* are formed on the outer wall of the rear end part of the rear cylinder 202 so that a rubber tube 213 is fixedly coupled on the rear end part. A tightening member 214 made of a wire or the like is wound on the rubber tube 213 so as to prevent the latter 213 from coming off the rear end part of the rear cylinder 202.

The valve pushing member and the valve member may be formed as one unit.

The operation of the tenth embodiment thus constructed will be described.

The rubber tube 213 is connected to the rear cylinder 202. When, under this condition, the main valve (not shown) at the other end of the rubber tube 213 is opened, a water pressure $P_0$ is applied to the inside of the rear cylinder 202, as a result of which the valve member 206 is pushed against the valve seat 205. That is, the valve opening is held closed as shown in FIG. 17 (with member 208 is pushed forwardly by the valve member 206 and, therefore, the front cylinder 201 moved together with the valve pushing member 208 is positioned away from the rear cylinder 202, and the radially displaceable members 209 are stretched tight. The inflating pressure of the grip cylinder 210 is applied to the fingers gripping the grip cylinder 210, and with the ordinary grasping force the radially displaceable members 209 will not be slackened. Therefore, the valve opening is maintained closed.

If the grip cylinder 210 is grasped with a force higher than the ordinary grasping force, the force of the fingers is applied radially inwardly to the radially displaceable members 209, so that the radially displaceable members 209 are radially inwardly bent. As a result, the front cylinder and the rear cylinder 202 are moved towards each other. Therefore, the valve pushing member 208 being integral with the front cylinder 201 is moved towards the rear cylinder 202 against the water pressure $P_0$, thus pushing the valve member 206 backwardly, so that the valve member 206 is moved away from the valve seat 205, that is, the valve opening is opened.

While the valve opening is opened, the water in the rear cylinder 202 is caused to flow through the central hole of the ring 207*a* of the cage 207, and through the slots 208*c* of the valve pushing member 208 into the latter 208. The water flows in the front and rear cylindrical parts 208*a* and 208*b* axially forwardly, and it is finally discharged through the opening 201*a* at the end of the front cylinder 201. The water flowing to the outside of the rear cylindrical part 208*a* of the valve pushing member 208 from the valve opening is detained by the O-ring 203. While the water is being discharged as described above, the valve member 206 is held in the stream of water. However, the rocking of the valve member 206 is prevented by the surrounding members 207*c* of the cage 207, that is, the resonance vibration of the valve member is prevented, and the valve member will not be displaced beyond the ring 207*a*.

The flow of water can be stopped merely by decreasing the grasping force of the fingers. As the grasping force decreases, the valve pushing member 208, to which the water pressure $P_1$ is applied through the valve member 206, is pushed back forwardly, and the radially displaceable members 209 are smoothly restored. Accordingly, the front cylinder 201 and the rear cylinder 202 moves away from each other, and the radially displaceable members 209 are stretched tight, and the valve member 206 comes into abutment against the valve seat 205, thereby closing the valve opening and restoring as shown in FIG. 17.

Figure 21:
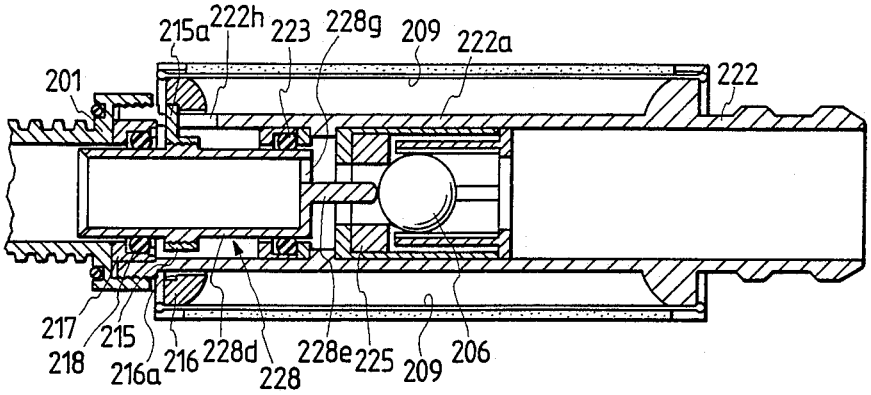
FIG. 21 is a perspective view showing a part of a eleventh embodiment of this invention.

FIG. 21 is a longitudinal sectional view showing an eleventh embodiment of the invention, in which the valve is closed.

In the eleventh embodiment, two or three slits **222*h* (three slits in FIG. 21) are formed in the front end portion of the extension 222*a* of a rear cylinder 222. A ring 215 is threadably mounted on the middle portion of a valve pushing member 228. The ring 215 has arms 215*a* protruding outwardly which are inserted into the above-described slits 222*h*, respectively. A sliding member 216 is slidably mounted on the front end portion of the extension 222*a* of the rear cylinder 222. When the arms 215*a* are inserted abutting against a step 216 formed in the front end portion of the sliding member 216*a* so that radially displaceable members 209 are held, the valve pushing member 228 pushes the valve member 206** backwardly.

The inner cylindrical wall relatively large in diameter of the rear end portion of a front cylinder 201 is threaded, while the outer cylindrical wall of the front end portion of the extension **222*a* of the rear cylinder 222 is also threaded, so that the front cylinder 201 is threadably engaged with the extension 222*a*. An O-ring retainer 217 is fitted on the inner cylindrical wall of the front end portion of the extension 222*a*, and an O-ring 218 is inserted in the O-ring retainer 217**, so that leakage of the water in the valve is prevented.

Figure 22:
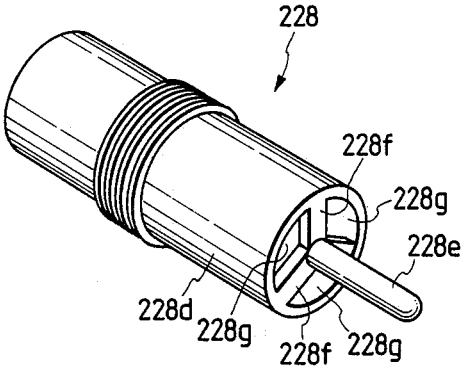
FIG. 22 is a perspective view showing essential components in the eleventh embodiment.

The front end portion of the valve pushing member 228 is formed into a cylindrical part **228*e*, and the rear end portion is formed into a rod 228*e* as shown in FIG. 22. The rod 208*e* is connected through a plurality of supporting arms 208*f* to the rear end of the cylindrical part 228*d*, thus forming windows 228*g* in the rear end face of the cylindrical part 228*d***.

In the eleventh embodiment, all the front end respect to the rear cylinder 222. That is, a part of the front end portion of the body, namely, the sliding member 216 moves back and forth, and an entire longitudinal length of the body is maintained unchanged. In this point, the eleventh embodiment is different from the tenth embodiment in which the front end portion is moved back and forth in its entirety. Another difference between the tenth and eleventh embodiments is as follows. The part of the valve pushing member 228 which directly pushes the valve member 206 is not cylindrical but a rod. The water flows around the rod **228*e* through the windows 228*g* into the cylindrical part 228*d* formed on the front end portion of the valve pushing member 228**.

Figure 23:
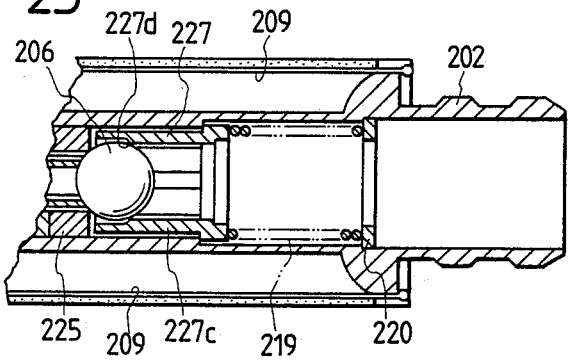
FIG. 23 is a longitudinal sectional view showing essential components in a twelfth embodiment of the invention.

FIG. 23 is a longitudinal sectional view showing essential components of a twelfth embodiment of the invention. In the twelfth embodiment, unlike the tenth and eleventh embodiments, in addition to the water pressure the elastic force of a spring 219 is utilized to push the valve member 206 against the valve seat 225. The spring 219 is interposed between the rear end face of a cage 227 and a spring pad 220 provided in the rear cylinder 202, so that the valve member 206 is pushed forwardly at all times through steps **227*d* formed in the front end portions of the inner surfaces of a plurality of surrounding members 227*c* which are similar to those in FIG. 19**. Therefore, even when the water pressure is low or not applied, the valve is positively closed.

Figure 24:
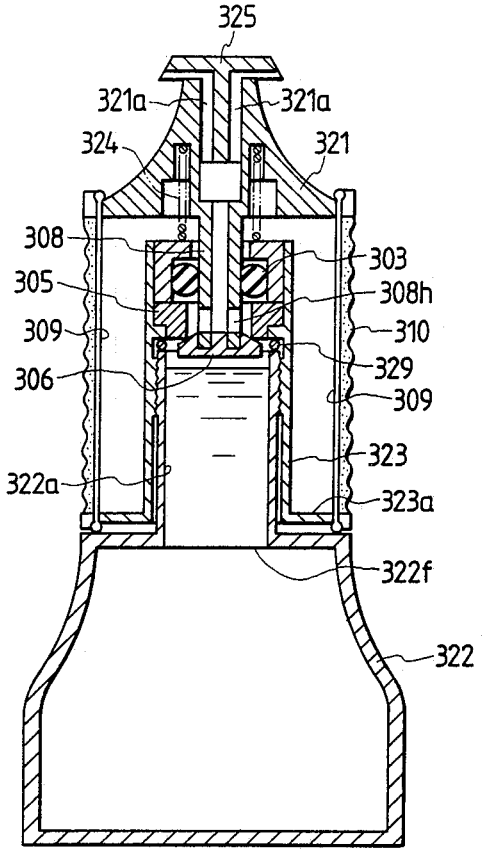
FIG. 24 is a sectional front view showing a thirteenth embodiment of the invention.

FIG. 24 is a sectional front view of a thirteenth embodiment of the invention, which is applied to soy pot. In this embodiment, a front end portion of its body is formed into a pot outlet member 321, and a rear end portion is formed into a container 322 from which the soy sauce is supplied forwardly through an inlet **322*f* of the container 322. A cylinder shaped external inserting member 323 is threadably and detachably mounted on a small diameter part 322*a* which is the front end portion of the container 322 (or the upper end portion cf the container 322 in FIG. 24). An O-ring 303 and a valve seat 305 are provided in the small diameter part 322*a*, and a valve pushing member 308 which positions at a rear end portion of the pot outlet member 321 is inserted into an external inserting member 323 from above until it is engaged with an annular groove of the valve member 306. This operation is carried out with a spring 324 inserted. A pot head 325 is inserted into the central hole which is formed in the front end portion of the pot outlet member 321. The pot head 325 has outlet grooves 321*a* and 321*a* which are formed at an outer cylindrical wall thereof in such a manner that the grooves are positioned diametrically opposite to each other and extending radially outwardly in the opposite directions at the end of the outer cylindrical wall. A radially displaceable members 309 are disposed between a periphery of the rear end face of the pct outlet member 321 and a rear end flange 323*a* of the external inserting member 323**, thus forming a grasping part.

The grasping part comprising the radially displaceable member 309, the pot outlet member 321, and the valve member 306 can be disconnected, as one unit, from the container 322 by turning the grasping part around the container, so that soy sauce can be supplied into the container 322 through a front opening thereof.

The soy pot thus constructed is held inclined with the soy outlet member underneath, with the grasping part held by hand. When, under this condition, the grasping force of the fingers is slightly increased, the radially displaceable members are radially displaced so that the valve member 306 and the valve seat 305 are moved away from each other against an elastic force of the spring 324, thus opening the valve. As a result, the soy sauce in the container is allowed to flow out of one of the outlet grooves **321*a*. In this operation, air goes in the pot through the other groove 321*a*. The flow of the soy sauce can be stopped with the pot outlet member 321** maintained as it is. That is, it can be stopped merely by decreasing the grasping force so that the valve opening is closed. Therefore, even if the soy pot is upset, the soy sauce will not flow out.

Figure 25:
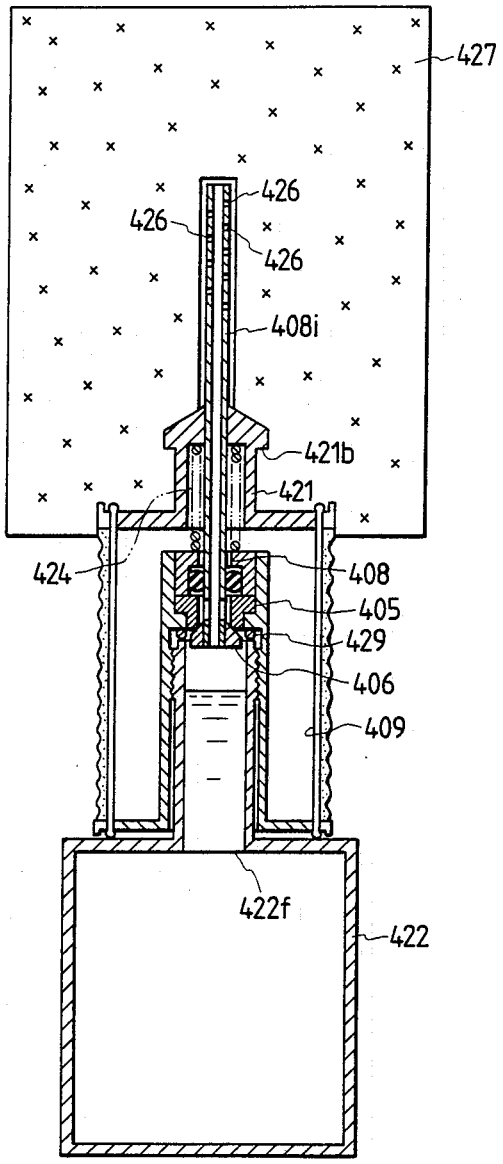
FIG. 25 is a sectional front view showing a fourteenth embodiment of the invention.

FIG. 25 is a sectional front view showing a fourteenth embodiment of the invention, which is applied to a detergent container. The fourteenth embodiment is one modification of the soy pot described above. In the fourteenth embodiment, a pipe-shaped valve pushing member 408 extends forwardly (upwardly in FIG. 25) through a pot outlet member 421; that is, the valve pushing member 408 has a pipe-shaped protrusion **408*i* appearing outside the pot outlet member 421. The pipe-shaped protrusion 408*i* opens at a front end thereof, and has a plurality of holes 426. The front end portion of the pot outlet member 421 is tapered, and has an undercut 421*b* which will retain a washing tool 427** such as a sponge or the like connected to the pot outlet member.

The washing tool of sponge may be so designed as to cover a grasping part comprising radially displaceable members 409, and the container 422. In this case, the washing tool may be in the form of a football. That is, the washing tool is not limited in configuration. In FIGS. 24 and 25, reference numeral 329 and 429, respectively, designate a packing.

While several embodiments of the invention have been illustrated and described in detail, it is particularly understood that the invention is not limited thereto or thereby.

The valve operating mechanism of the invention has a wide range of application, because it is formed on the conditions that the two members pulled away from each other with a strong force are connected to each other through the radially displaceable members in such a manner that the latter are stretched tight, and the two members are moved towards each other by application of a small force to the middle of the radially displaceable member.

That is, the radially displaceable members have following characteristics: readily radially displaceable; hardly axially stretched or substantially inextensible, strong in a stretch; positively be restored to its original shape; and when a part of the members is radially displaced, the remaining parts will not obstruct the radially displacement of the part. In view of these characteristics, the radially displaceable members may be formed by a line, a metal wire, a gauze, a flexible cloth, a net, a flexible thin metal plate, a metal having a plurality of longitudinal slits, a cylinder formed of a synthetic resin or the like.

Furthermore, a bag-shaped or net-shaped radially displaceable member formed by weaving the radially displaceable members may be used. In addition, a cylindrical radially displaceable member having a number of slits in its surrounding wall may be molded.

Further, instead of the radially displaceable members, flexible lever members may be employed as the radially displaceable members. Furthermore, lever members having a cam surface at one end may the used. The lever members are not extended nor contracted. That is, the lever members are so designed that they are displaced radially to cause the cam surfaces to move the mating part axially.

In addition, the above-described embodiments may be modified or changed without departing from the invention. For instance, the components which are brought into contact with the flow of water may be rounded or shaped streamlined to decrease the resistance.

The technical concept of the invention that the valve is normally closed to block the flow of fluid, and it is opened by application of a grasping force to the radially displaceable member can be realized as a variety of mechanisms. It goes without saying that different devices formed according to the invention are different in the size, configuration and material of the components, and in the method of assembling the components, and the mechanisms may be modified or changed, or some of the components may be formed as one unit, without departing from the invention.

According to the above-described embodiments, the valve member is positioned close to the pen core, that is, a front part of the writing instrument body. However, the valve member may be positioned at a rear part of the body. In this arrangement, a supply amount of the ink by one valve operation is increased and, therefore, such a writing instrument is suitable for that which requires a relatively large amount of the ink consumed. On the other hand, if an extra ink container is provided between the pen core and the valve member, the supply amount of the ink by one valve operation is increased even with the writing instrument in which the valve member is positioned at the front part of the body.

According to the sixth and ninth embodiments, the valve member stops moving by abutting against an inner wall of the front cap so that a maximum opening degree of the valve is limited. In the other embodiments, it may be preferable that a stopper for preventing a further rearward movement of the valve is provided so that the maximum opening degree of the valve is limited. If such an arrangement is applied to the ninth embodiment, a constant ink amount can always be supplied while the writer grasps the radially displaceable member with a grasping force which is larger than a predetermined level.

According to the ninth embodiment in which the writer always grasps the radially displaceable member rather than the grasp cylinder, an entire longitudinal length of the writing instrument body is shortened when the valve operating mechanism is actually operated during the writing. However, this embodiment may be so arranged that the entire longitudinal length of the body does not change even if the valve operating mechanism is operated during the writing.

In the embodiments described above, the pen core is formed by pressing fibers into a mass such as a felt. However, the pen core may be formed of a plastic resin having many axial slit through which ink passes. Further, the pen core is not limited to that inner side of which the ink is supplied through. That is, another type of a pen core may be applicable outer periphery of which the ink is led.

The present invention has the following effects:

(1) In the writing instrument using ink or in the makeup liquid applying instrument, it is unnecessary to push the tip to open the valve, and therefore the tip may be soft or suitable for the purpose of use. Since the valve is opened and closed merely by controlling the grasping force applied to the grasping portion of the instrument, the flow of liquid can be readily controlled; that is, the instrument can be readily operated. Furthermore, the instrument is simple in construction and positive in operation.

(2) In the case where the invention is applied to a kitchen appliance or a household utensil, even when it is set upside down, the content will not flow out, because its valve is normally kept closed. Furthermore, the flow rate of the fluid can be controlled merely by increasing or decreasing the grasping force applied to the grasping portion of the kitchen appliance or the house-hold utensil; that is, the kitchen appliance or household utensil formed according to the invention is excellent in practical use, and the fluid can be economically used. If the kitchen appliance or household utensil is so designed that its mechanical part is separately formed and is combined with its disposal part in use, it can be more economically used.

(3) The appliance using water formed according to the invention is practical in use, because the valve can be opened and closed with one hand. The flow of water is stopped by decreasing the grasping force; that is, water can be economically used. Furthermore, it is unnecessary to worry about whether the valve has been closed or not after the use of it.

(4) The valve can be opened or closed merely by increasing or decreasing the grasping force of the fingers which hold the grasping part comprising the radially displaceable members. Therefore, the valve of a hand-held liquid appliance can be opened and closed with the hand holding the hand-held liquid appliance; that is, it is unnecessary to use both of the hands to open and close the valve. In opening or closing the valve, the fingers are not forced to operate unnaturally, pulling or pushing. That is, the valve can be opened or closed by the natural operation of the fingers, merely by pinching or gripping.

(5) The valve opening and closing operation can be achieved with the hand holding the hand-held liquid appliance, and the valve can be opened or closed without delay when required. Therefore, the liquid such as water can be economically used.

(6) If the mechanism is so designed that, when the valve is opened or closed by increasing or decreasing the grasping force applied to the grasping part, a part of the body is moved with respect to the rear end portion, then the operation is carried out stably. If the device is so designed that, in the valve opening and closing operations, the body is maintained unchanged in length, and the front end portion of the body is operated, then the device will be simple in construction and can be manufactured at low cost.

(7) The valve operating mechanism of the invention is capable of supplying a required supply amount of the ink contained in the ink tank without changing a grasping position of the fingers.

What is claimed is:

1. A value operating mechanism, comprising:

an elongated hollow body comprising a pair of rigid longitudinally spaced sections;

a valve means provided within said body for controlling fluid flow through said body;

a longitudinally extending and substantially inextensible radially displaceable means provided on said body and interconnecting said sections;

biasing means disposed within said hollow body for continuously applying a biasing force in a direction which longitudinally separates said sections and closes said valve means, said radially displaceable means being coupled to said biasing means and said body sections such that said radially displaceable means is biased in an axial direction of said hollow body by the biasing force; and means for opening said valve means in accordance with a radial displacement of said radially displaceable means in a radial direction with respect to said hollow body, the longitudinal distance between said body sections and the longitudinal length of said radially displaceable means being shortened when said radially displaceable means is radially displaced in said radial direction.

2. A value operating mechanism, comprising:

an elongated hollow body comprising a pair of rigid longitudinally spaced sections;

a valve means having a valve member and a valve seat, said valve means being provided within said body and controlling fluid flow through said body;

a longitudinally extending and substantially inextensible radially displaceable means provided at a periphery of said hollow body and interconnecting said body sections; and means for translating the radial displacement of said radially displaceable means into a relative movement between said valve member and said valve seat so as to open said valve means, the longitudinal distance between said body sections and the longitudinal length of said radially displaceable means being shortened when said radially displaceable means is radially displaced, and means disposed within said hollow body for applying a biasing force in a direction which longitudinally separates said sections and closes said valve means, said radially displaceable means being coupled to said applying means and said body sections such that said radially displaceable means is biased in an axial direction of said hollow body by the biasing force.

3. The valve operating mechanism of claim 2, wherein said radially displaceable means is formed of a material having following characteristics:

readily radially displaceable;

hardly axially stretched;

strong in a stretch;

positively restored to its original condition; and when a part of said means is radially displaced, the remaining parts will not obstruct the radially displacement of said part.

4. The valve operating mechanism of claim 3, wherein said radially displaceable means is formed of at least one line.

5. The valve operating mechanism of claim 4, wherein said line is formed of a resin mono-filament.

6. The valve operating mechanism of claim 3, wherein said radially displaceable means is formed of at least one metal wire.

7. The valve operating mechanism of claim 3, wherein said radially displaceable means is formed of a gauze.

8. The valve operating mechanism of claim 3, wherein said radially displaceable means is formed of a flexible cloth.

9. The valve operating mechanism of claim 3, wherein said radially displaceable means is formed of a net.

10. The valve operating mechanism of claim 3, wherein said radially displaceable means is formed of a cylinder formed of a synthetic resin.

11. The valve operating mechanism of claim 2, wherein the open degree of said valve means corresponds to the force applied to said radially displaceable means whereby controlling a supply amount of said fluid.

12. The valve operating mechanism of claim 11, wherein said valve means is opened by a relatively weak force applied to said radially displaceable means.

13. The valve operating mechanism of claim 11, wherein said valve means is opened by a relatively strong force applied to said radially displaceable means while said valve means will not be opened by a relatively weak force.

14. The valve operating mechanism of claim 2, wherein an entire longitudinal length of said cylindrical body is shortened when said radially displaceable means is radially displaced.

15. The valve operating mechanism of claim 2, further comprising:

an axially movable member provided at a front portion of said cylindrical body;

an ear press fitted into said axially movable member;

a slide pipe press fitted into a front portion of said valve seat;

a pipe-shaped leg engaged between said axially movable member and said valve member;

a spring always urging said valve seat against said valve member;

a fluid tank provided in a rear part in said cylindrical body, said fluid tank containing therein a fluid; and an ink leading core provided within said leg.

16. The valve operating mechanism of claim 15, wherein said radially displaceable means couples said valve seat to said axially movable member.

17. The valve operating mechanism of claim 15, further comprising a spring disposed between said axially movable member and said slide pipe.

18. The valve operating mechanism of claim 15, further comprising a spring disposed between said valve member and a ring fitted inside of a rear part of said valve seat.

19. The valve operating mechanism of claim 2, further comprising:

a fluid supply tube mounted on a rear end of said body;

a fluid injecting pipe mounted on a front end of said body;

an axially movable member mounted on said fluid injecting pipe;

a leg extending forwardly from a front part of said valve member; and a cylinder provided within said body, said cylinder being connected to said valve member by said leg, wherein said axially movable member is coupled to said valve seat by said radially displaceable means and said valve member is always urged by a fluid pressure against said valve seat.

20. The valve operating mechanism of claim 2, further comprising:

a grasp cylinder provided on a periphery of said body at a front side of said radially displaceable means;

a front cap having a through hole;

a pen core press fitted in said front cap;

a fluid tank forming a rear part of said body;

a coupling pipe coupling said fluid tank to said valve seat; and a spring disposed between a front end of said coupling pipe and said valve member, said spring always urging said valve member against said valve seat, wherein said grasp cylinder and said fluid tank are coupled by said radially displaceable means.

21. The valve operating mechanism of claim 2, further comprising:

a grasp cylinder forming a front part of said body, said grasp cylinder having a through hole;

a fluid tank forming a rear part of said body;

a pen core press fitted in a front end of said grasp cylinder;

a cylindrical valve seat holder retaining said valve seat at a front end thereof, said valve seat holder having a coupling pipe extending rearwardly;

a connecting bar extending rearwardly from said valve member, said connecting bar passing through said coupling pipe, said connecting bar connecting said valve member to said fluid tank; and a spring disposed between said coupling pipe and said fluid tank, said spring always urging said valve seat holder against said valve member, wherein said grasp cylinder is coupled to said fluid tank by said radially displaceable means.

22. The valve operating mechanism of claim 2, further comprising:

a fluid tank forming a rear part of said body;

a fluid container provided inside of said body, said fluid container containing therein a fluid and said valve means, a front end of said fluid container forming a front metal in which a pen core is press fitted;

a grasp cylinder provided at a periphery of a front part of said body, said grasp cylinder extending radially inwardly to form a connecting bar to which said valve member connected, said grasp cylinder being slidable on said fluid container;

a communicating pipe connecting said fluid container and said fluid tank; and a spring provided between said valve member and said communicating pipe, wherein said grasp cylinder is coupled to said fluid tank by said radially displaceable means.

23. The valve operating mechanism of claim 2, further comprising:

a grasp cylinder provided at a periphery of a front part of said cylindrical body, said grasp cylinder having a front tapered portion forming a front metal;

a pen core press fitted in said front metal of said grasp cylinder;

a fluid container disposed within said grasp cylinder, said fluid container containing therein said valve means, a fluid tank forming a rear part of said body;

a coupling pipe coupled to said fluid container, said coupling pipe being provided with a sliding member extending radially outwardly, said sliding member being slidable on said fluid tank;

a connecting bar extending rearwardly from said valve member, said connecting bar passing through said coupling pipe, said connecting bar being fixed to said fluid tank;

a fixing pipe fixing said grasp cylinder to said fluid tank; and a spring provided between said valve member and said coupling pipe, wherein said grasp cylinder being coupled to said sliding member by said radially displaceable means.

24. The valve operating mechanism of claim 2, further comprising:

a fluid tank forming a rear part of said cylindrical body;

a hollow axially movable member forming a front part of said cylindrical body, said axially movable member containing therein said valve means;

a pen core press fitted in said axially movable member;

a coupling pipe extending frontwardly from said fluid tank;

a connecting bar extending rearwardly from said valve member, said connecting bar being connected to said coupling pipe; and a spring provided between said coupling pipe and said valve member, wherein said axially movable member is coupled to said fluid tank by said radially displaceable means.

25. The valve operating mechanism of claim 2, further comprising:

a front cylinder;

a rear cylinder coupled to said front cylinder by said radially displaceable means, said rear cylinder containing therein a valve means; and a valve pushing member connected to said front cylinder, said valve pushing member extending rearwardly from said front cylinder, wherein said valve seat is fixed inside of said rear cylinder.

26. The valve operating mechanism of claim 25, wherein said radially displaceable means comprises at least one line member provided with a P-ring at both end thereof.

27. The valve operating mechanism of claim 25, wherein said valve member is a ball.

28. The valve operating mechanism of claim 25, further comprising a cage provided inside of said rear cylinder, said cage being engageable with said valve member.

29. The valve operating mechanism of claim 25, wherein said valve pushing member comprises a cylinder having at least one slot.

30. The valve operating mechanism of claim 25, wherein said valve pushing member comprises a rod.

31. The valve operating mechanism of claim 25, further comprising a spring provided between said rear cylinder and said cage, whereby always urging said valve member against said valve seat.

32. The valve operating mechanism of claim 2, further comprising:

an axially movable member disposed at a front end of said body, said axially movable member being hollow through which the fluid passes;

a fluid tank forming a rear part of said body, said fluid tank extending inside of said radially displaceable means to form a cylinder containing therein said valve means;

a head having at least one groove, said head being detachably engaged with said axially movable member;

a connecting leg extending from said valve member, said connecting leg being unitary formed with said axially movable member; and a spring provided between said axially movable member and said cylinder.

33. The valve operating mechanism of claim 32, further comprising a protrusion extending from said head, said protrusion having a plurality of holes.

34. The valve operating mechanism of claim 33, wherein said head is tapered to which a sponge is engaged.

35. The valve operating mechanism of claim 24, further comprising a cotton like member acting as an ink container, said cotton like member being disposed in said grasp cylinder at a front side of said valve member.

36. The valve operating mechanism of claim 24, further comprising an inner and an outer rings, wherein said radially displaceable means is fixed at both end thereof by said inner and outer rings.

37. The valve operating mechanism of claim 24, further comprising two U-shaped metal retainers, wherein said radially displaceable means is fixed at both end thereof by said U-shaped metal retainers.

38. The valve operating mechanism of claim 2, wherein an entire longitudinal length of said cylindrical body does not change even if said radially displaceable means is radially displaced.

39. A valve operating mechanism, comprising:

a hollow body;

a valve means having a valve member and a valve seat, said valve means being provided within said hollow body;

a radially displaceable means provided at a periphery of said hollow body;

means for translating the radial displacement of said radially displaceable means into a relative movement between said valve member and said valve seat;

a fluid tank provided at a rear part of said body, said fluid tank containing therein a fluid;

an axially movable member provided at a front portion of said body;

a slide pipe press fitted in a rear portion of said axially movable member;

a holder supporting member provided in a front opening of said axially movable member;

an ear press fitted into said holder supporting member;

a coupling pipe coupling said holder supporting member and said valve seat, said coupling pipe providing communication between said ear and said fluid tank;

a leg extending forwardly from said valve member;

an annular magnet disposed inside of said slide pipe;

at least one short-bar-shaped magnet disposed on said leg, said short-bar-shaped magnet being position inside of said annular magnet;

a retainer provided inside of a rear part of said valve seat; and a spring disposed between said valve member and said retainer, said spring always urging said valve member against said valve seat, wherein said axially movable member is coupled to said valve seat by said radially displaceable means.

* * * * *